United States Patent [19]

Simeau

[11] 3,943,386

[45] Mar. 9, 1976

[54] BURNER FUEL SUPPLY CONTROL SIGNAL GENERATING DEVICE

[75] Inventor: Bernard Jules Alexandre Simeau, Chadrac, France

[73] Assignee: Constructions Electriques R.V., Le Puy, France

[22] Filed: July 3, 1974

[21] Appl. No.: 485,349

[30] Foreign Application Priority Data

July 17, 1973 France ..... 73.26130

[52] U.S. Cl. ..... 307/310; 328/6; 340/227 R; 340/228 R; 331/66

[51] Int. Cl.[2] ..... H01H 37/32

[58] Field of Search ..... 328/6; 307/310; 340/227 R, 340/228 R; 331/66

[56] References Cited

UNITED STATES PATENTS

| | | | |
|---|---|---|---|
| 3,378,829 | 4/1968 | Alafi et al. | 331/66 X |
| 3,414,739 | 12/1968 | Paidosh | 307/310 X |
| 3,671,815 | 6/1972 | Eberle et al. | 328/6 X |
| 3,701,137 | 10/1972 | Hulsman | 328/6 X |
| 3,710,149 | 1/1973 | Thomson | 307/310 |

*Primary Examiner*—John S. Heyman

[57] ABSTRACT

The device comprises flame detection means and a generating circuit adapted to deliver a signal when a flame signal, generated by the flame detection means, is applied to one of its inputs. The generating circuit is arranged so as to be unable to deliver an actuating signal in the case of failure of one of its elements, even if a flame signal is applied to said input. The circuit comprises oscillator means including a triggering input adapted to receive a triggering signal of low value and means for applying the flame signal to said triggering input. The oscillator means is arranged to generate a periodic signal of substantially constant peak to peak amplitude and of value substantially higher than that of the triggering signal, when a signal appears on said triggering input having a value between predetermined limits.

15 Claims, 2 Drawing Figures

Figure 1:
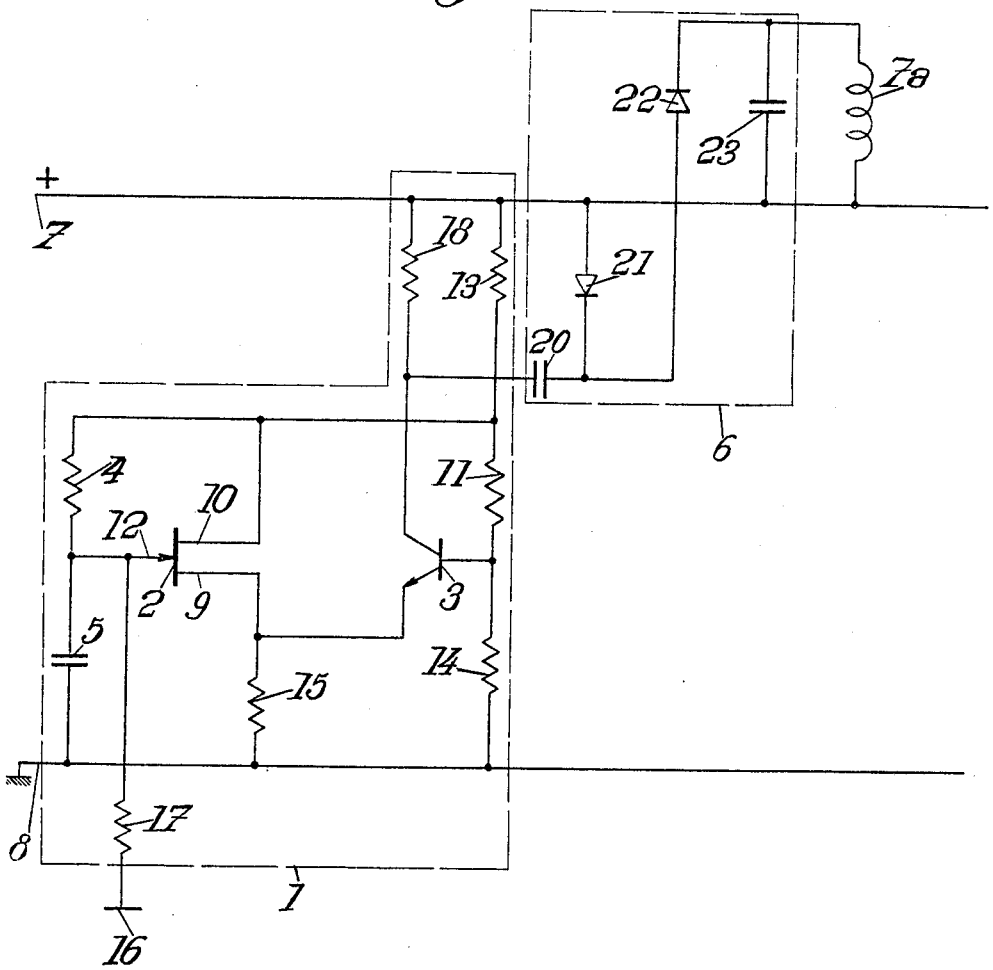

60
51
52
53
7'(+)
40
7a
22a
23a
30
32
35
34
36
27a
20a
54
4a
2a
31
55
10a
33a
33
3a
41
8a
17a
48
47a
50
1a
46
47
49
16a
42
45
44
43

BURNER FUEL SUPPLY CONTROL SIGNAL GENERATING DEVICE

This invention relates to a burner fuel supply control signal generating device. It relates more particularly to a generating device is adapted to deliver a control signal if a flame signal, representing the presence of a burner flame, is applied to one of its inputs. In addition, the device is arranged so as not to deliver a control signal in case one of its elements fails.

The device in accodance with this invention is used advantageously but not exclusively in combination with a flame detection device adapted to deliver a flame signal of very low value, of the order of a microampere. Such a flame detection device can be for example of the "ionization" type, that is to say that it uses the rectifying properties of the flame to generate said flame signal.

The invention relates also to improvements in or to a flame detection device of the ionization type.

Of course, the generating devices concerned must only supply a control signal if a flame signal is applied to the input. In other words, such devices, must not permit the supply of fuel to a burner when the flame signal ceases to be applied to the input.

Such devices which include an amplifier are already known, but known assemblies of this type are complex, expensive or bulky and their operation does not always provide the necessary safety.

It is an object of the invention to overcome the above-mentioned drawbacks and especially to supply a generating device of the type concerned which is simple and economic to manufacture and in which failure of any one of its components prevents the supply of a control or actuating signal.

Another object of the invention is to supply an actuating device which is not sensitive to interference having the frequency of the electric current supply system.

It is a further object of the invention to enable the production of such an actuating device which can be used with a burner for which the flame signal is capable of varying within a wide range.

Another object of the invention is to provide a flame detection device of the ionization type which can be supplied with electrical energy by any type of supply system.

A generating device for a burner fuel supply actuating signal of the type concerned is, according to the invention, characterized in that it comprises oscillator means includidng a triggering input of small magnitude and means for applying the flame signal to said triggering input, the oscillator means being arranged to generate a periodic signal of substantially constant peak to peak amplitude and of a value distinctly higher than the triggering signal, on the appearance of a signal on said triggering input whose value is between predetermined limits.

Preferably the oscillator means comprise a multivibrator including a field effect transistor and a bi-polar transistor, the triggering input being connected to the gate of said field effect transistor.

The flame detection device of the instant invention is a fail safe device and includes a first and second electrode between which the flame appears, this flame having substantially the properties of a diode between these electrodes. Two input terminals are provided which are adapted to be connected to an alternating current supply system. Further according to the invention, the flame detection device comprises a first resistance of high value and a first connecting capacitor in series between the first input terminal and the assembly of a second resistance and of a second capacitor installed in series so that one of the plates of this second capacitor is connected to the second input terminal, the terminal of the second resistance which is not connected to the second capacitor being connected to said first electrode and the second electrode being connected to the second input terminal through a third resistance of high value.

Figure 2:
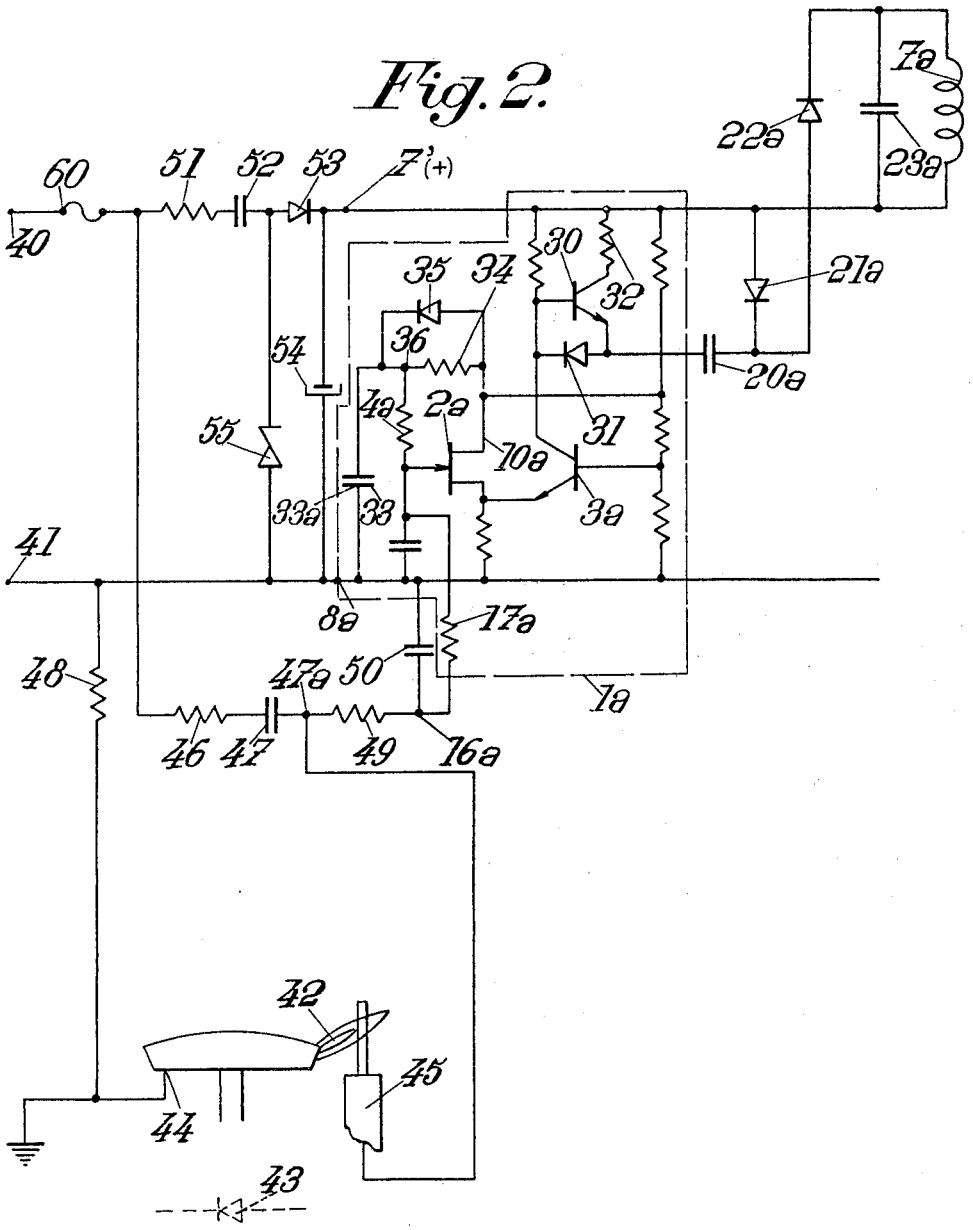

Other objects, advantages and features of the invention will appear in the course of the description of preferred embodiments of the invention which follows, this description being given with reference to the accompanying drawings by way of non-limiting examples, and in which:

FIG. 1 shows one embodiment of an actuating device according to the invention, and, FIG. 2 illustrates a modification of the embodiment shown in FIG. 1 in combination with a flame detection device according to the invention.

The embodiment of the invention which is shown in FIG. 1 comprises an oscillator 1 which in turn comprises a multivibrator composed essentially of a field effect transistor 2, of the N band type, and a bipolar transistor 3 of the NPN conductivity type. In addition, a reaction circuit comprising, a resistor 4 of high value and a capacitor 5, permits the operation of this multivibrator as an oscillator under conditions which will be described below.

The signal generated by the oscillator means 1 is employed by rectifier means 6 to supply an actuating signal to the terminals of a coil 7*a* of an electrovalve for supplying fuel to the burner (not shown). In this embodiment shown in FIG. 1, the rectifier means comprise a device of the voltage doubler type which will be described below.

A DC source (not shown) delivers the necessary supply signal for the operation of this actuating device. In the embodiment shown this source applies a positive potential (+) to a terminal 7 and a zero potential (O) to a terminal 8.

In the example, the emitter of the transistor 3 is connected to the source 9 of the transistor 2 and the drain 10 of the transistor 2 is connected to the base of the transistor 3 through a resistance 11.

The gate 12 of the field effect transistor 2 is connected to the terminal 7 (+) through the resistance 4 and a resistance 13 in series. Moreover, the terminal common to the resistances 4 and 13 is connected to the drain 10.

The base of the transistor 3 is connected to the terminal 8 by means of a resistance 14. A resistance 15, of low value, ensures connection between the source 9 (and hence the emitter of the transistor 3) and said terminal 8.

The input 16 adapted to receive the flame signal is connected to the gate 12 of FET transistor 2 by means of a resistance 17. The capacitor 5 is connected between the gate 12 of the transistor 2 and the terminal 8. A resistance 18, lastly, connects the collector of the transistor 3 to the terminal 7.

Rectifier means 6 of the voltage doubler type comprise a capacitor 20 connected to the collector of the transistor 3, a first diode 21 whose cathode is connected to a plate of the capacitor 20 and whose anode is connected to the terminal 7. This voltage doubler comprises in addition, a second diode 22 whose anode is connected to the cathode of the diode 21 and whose cathode is connected to the terminal 7 by means of a capacitor 23. The capacitor 23 is in parallel with the coil 7*a*.

As regards the operation of the generating device which has just been described with relation to FIG. 1, it should be indicated that the operation as an oscillator of this assembly is rendered possible particularly due to the presence of the reaction circuit composed of the resistance 4 and the capacitor 5. Moreover, as will be seen below, this operation as an oscillator is only possible when the magnitude of the current absorbed by resistor 17 is between predetermined limits, that is to say when the potential applied to the terminal 16 is also between predetermined limits. In other words, if the signal appearing at the terminal 16 has too low or too high a value the oscillator 1 will not supply a signal to the output and the coil 7*a* can not be supplied and, finally, fuel can not be delivered to the burner.

It is also important to indicate that the flame signal occurs in such a way that the potential applied to the terminal 16 is at a level less than that applied to the terminal 8; in other words, this potential is negative.

If it is assumed that the field effect transistor 2 is, initially, the conductive state and if a negative potential (flame signal) is applied to the terminal 16, the currents flowing through the resistors 4 and 17 will permit the application of a negative potential to the gate 12 which causes the current in transistor 2 to be pinched off. When transistor 2 is off or in the blocked state, the potential of the drain 10 increases to a positive value and the current flowing through the resistors 4 and 17 enables the application of a positive potential to the gate 12. The transistor 2 can, thus, return to the conductive state and this assembly can hence operate well as an oscillator. It must however be noted that the frequency of oscillation of the oscillator 1 depends on the capacity of the capacitor 5.

It was indicated above that the operation of the oscillator was only possible if the potential of the terminal 16 was between pre-determined limits. In fact, if the potential of this terminal 16 is too negative transistor 2 can remain constantly, in the blocked state and, reciprocally, if the absolute value of the potential applied to the terminal 16 is too low the potential of the gate 12 of the transistor 2 can remain constantly positive and this transistor 2 then remains constantly conducting. In both cases operation as an oscillator would not be possible.

It should be noted that preferably a high value will be selected, of the order of several megohms, for the resistor 4 so that the electric current absorbed by the resistor 17 has a low value, preferably of the order of some microamperes, so as to be able to use a flame detection device employing the rectifying properties of said flame, which detection device will be described with reference to FIG. 2.

It will be noted also that the frequency of oscillation of the oscillator 1 has, in the preferred embodiment of the invention, a high value. To this end, the capacity of the capacitor 5 has a low value, of the order of some tens of picofarads. In the example this frequency is comprised between 800 and 3000 Herz. The latter feature enables the use of capacitors 20 and 23 having capacities of the order of a microfarad and capable of being constructed with reduced dimensions according to the so-called metallized film technique.

In fact, for lower frequencies (for example 50 Hz) it would be necessary, on the contrary, to use capacitors of the electrochemical type. Moreover, the high frequency of the signals supplied by the oscillator 1 renders the device insensitive to interference which could arise from the AC electric supply system whose frequency is generally of the order of 50 or 60 Hz.

This advantage of reduced bulk is further increased since the assembly described does not include a transformer.

It will be observed that the fact of fixing the potential of the terminal 16 at a negative value, with respect to that of terminal 8, offers also a guarantee of safety for operation of the device, especially in the case of possible faulty insulation.

It will be noted lastly that oscillator 1 does not deliver a signal to the output when one of its components is cut or short-circuited. Moreover, a change in values of the characteristics of the components can only either reduce the output power supplied at the terminals of the coil 7*a*, or block the oscillator 1 (that is to say prevent the supply of a signal tothe terminals of said coil 7*a*).

Thus, in the case of a considerable increase in temperature, a leakage current would appear countering the current absorbed in the resistor 17 and in this case, the potential of the gate 12 can remain positive, preventing the operation of the assembly with transistors 2 and 3 as an oscillator. It was also noted that faults in insulation of the electrode of the gate 12 with respect to the other electrodes of the field effect transistor 2 could also not maintain the oscillator 1 in oscillation.

The voltage doubler device enables the potential of the terminal of the coil 7*a* to be fixed, which coil is not connected to the terminal 7 at a potential higher than this terminal. This feature also offers the necessary safety guarantee in case of failure.

There will now be described with relation to FIG. 2 a modification of the generating device shown in FIG. 1, this generating device being associated with a flame detection device according to the invention.

In the embodiment of the generating device there is provided, similarly to FIG. 1, an oscillator 1*a* comprising a field effect transistor 2*a* and a bipolar transistor 3*a*, as well as a voltage doubler device comprising two capacitors 20*a* and 23*a* and two diodes 21*a* and 22*a* mounted in the same manner as in the embodiment shown in FIG. 1.

However, in this embodiment, there is provided an impedance adaptation assembly between the output (collector of the transistor 3*a*) of the oscillator 1*a* and the input of the voltage doubler device. This impedance adaptation assembly comprises a bipolar transistor 30 of the same conductivity type, namely the NPN type, as the transistor 3*a* and a diode 31.

In FIG. 2, the base of the transistor 30 is connected to the collector of the transistor 3*a* and the collector of said transistor 30 is connected to the terminal 7' (+) through a resistor 32 of low value. The anode of the diode 31 is connected to the emitter of the transistor 30 and the cathode of this diode is connected to the collector of the transistor 3*a*.

Thus, the output impedance of the oscillator 1*a* is less than in the absence of such an assembly and the power delivered at the input of the voltage doubler is hence greater. Moreover, it is possible to show that this impedance adaptation assembly also guarantees the safety of operation of the device according to the invention, that is to say that any failure of one of its components can only prevent the supply of a signal to the terminals of the coil 7*a*.

The actuating signal generating device shown in FIG. 2 is distinguished from that shown in FIG. 1 by another feature, that will be described below, and which enables the limits between which the flame signal must be comprised to be extended.

To this end, there is provided an additional capacitor 33 of which a first plate 33*a* is connected to the terminal 8*a* of lower potential of the electrical energy supply source of the oscillator 1*a* and whose other plate is connected to that (36) of the terminals of the resistor 4*a* which is not connected to the plate of the field effect transistor 2*a*. In addition, a resistor 34, is interposed between the terminal 36 and the drain 10*a* of transistor 2*a*. A diode 35, lastly, is connected in parallel with the resistor 34 so that its cathode is connected to the terminal 36.

With this arrangement, the charging of the capacitor 33 is effected by means of the diode 35 and the discharging of said capacitor is effected through the resistor 34. In this way, the discharging of the capacitor 33 is slower than its charging. Thus the discharging of the capacitor 33 can be incomplete when the transistor switches from the conductive state to the blocked state. Therefore, the potential of the terminal 36 has a value greater than it would have, in the absence of said capacitor 33. This permits the limits between which the potentials of the terminals 16*a* must be held for the oscillator 1*a* to be able to deliver an actuating signal to be well extended. In other words, the current absorbed by the resistor 17*a* can have greater values. For example, in the absence of the capacitor 33, of the resistor 34 and the diode 35, the intensity of the current passing through the resistor 17*a*, which enables the triggering of the oscillator 1*a*, must be between 0.5 and 1 microampere whilst with said elements this intensity can be between 0.5 and 5 microamperes.

The fact that the maximum intensity of the admissible current in the resistor 17*a* has been increased due to the capacitor 33 and to its charging and discharging circuits does not spoil the safety of operation of the generating device according to the invention. On the contrary, this feature is particularly advantageous in various circumstances. In particular, in the characteristics of the electronic components of the generating device or of the flame detection device which will be described below vary in minor proportion, the generating device will be able to operate normally. In addition, if as shown in FIG. 2, the flame detection device is supplied with alternating current by a distributing network it will then be possible to supply this detection device through various types of such supply networks and the over or under-voltages of this network will not inadvertently disturb the operation of the generating device. Finally, in the case where the flame detection device uses the rectifying properties of said flame, the variations in resistance of the flame diode will not disturb the operation of the generating device. The conductibility of the flame depends in fact on its dimensions and on its oxidizing or reducing nature.

There will now be described the flame detection device which is shown in FIG. 2 and which can be used with the actuating signal generating device according to the invention; this detection device can however also be used for other applications.

This flame detection circuit is connected between the terminals 40 and 41 of an electrical energy distributing system. This flame detection device uses the rectifying properties of the flame 42. It is known in fact that a flame has substantially the characteristics of a diode; however, the direct resistance of such a "flame diode" is relatively high: it can reach 100 megohms. In order to illustrate the characteristics of this diode there is shown, in FIG. 2, below the flame 42, in interrupted lines, a diode 43. In the example shown the electrode 44, connected to the body of the burner, constitutes the cathode of the flame diode and the electrode 45 constitutes the anode of said flame diode.

According to the invention, the flame detection device which is adapted to generate a flame signal and to deliver it to the input 16*a* of the actuating signal generating device, according to the invention, comprises, firstly, a resistor 46 of high value of which one terminal is connected to the terminal 40 and a capacitor 47 in series with the resistance 46.

This flame detection device comprises also said flame diode 42 which is connected, on one side, to one plate of the capacitor 47 and on the other side, to a resistance 48 of high value, this resistance 48 being connected to the terminal 41. Thus, the elements 46, 47, 42 and 48 are connected in series between the terminals 40 and 41.

In addition, the terminal 47a, common to the capacitor 47 and to the electrode 45, is connected to the terminal 16*a* through a resistor 49 which also has a high value. Moreover, a capacitor 50 connects the terminal 16*a* to the terminal 41 (or 8*a*).

It is to be noted that the electrode 44 is connected to earth and that the elements 46 and 47 may be permuted.

The flame diode rectifies the signal delivered between the terminals 47*a* and 44 and thus the flame signal applied to the terminal 16*a* or, more accurately, between the plates of the capacitor 50, is a substantially continuous signal. The resistance 49 and the capacitor 50 serve also for filtering this signal.

It is to be noted also that the high value of the resistance 48 connecting the mass of the burner to the terminal 41 limits the possible leakage currents which could be dangerous. This resistance 48 of high value hence avoids the use of an isolation transformer and limits the bulk of the device.

Preferably the ratios of the values of the resistors 46 and 49 are between 0.25 and 4 so that the detection device can supply a flame signal whatever the type of distribution network for alternating current used. In fact, with this arrangement, it is not necessary to set the neutral or to operate a distinction between the phases.

It will be noted lastly that said ratio between the values of the resistors 46 and 49 is advantageously equal to 0.5 or 2.

It can be easily demonstrated that this flame detection device can not supply a flame signal in the case of failure of one of its components or of one of its connecting elements.

In the preferred embodiment of the invention which is shown in FIG. 2, there are also provided rectifying means enabling the actuating signal generating device to be supplied with direct current, (between the terminals 7' and 8*a*) thereby rectifying the alternating signal provided between the terminals 40 and 41.

This rectifier is a voltage doubler comprising a resistance 51 of which one terminal is connected to terminal 40 and of which the other terminal is connected to a first place of a capacitor 52. The second plate of the capacitor 52 is connected to the anode of a diode 53 of which the cathode is connected directly to the terminal 7'. A filtering capacitor 54 is installed between the terminals 7' and 8*a* (or 41). The cathode of a Zener diode 55, lastly, is connected to the common terminal to the capacitor 52 and to the diode 53; the anode of this diode 55 being connected to the terminals 41.

This arrangement, in which a Zener diode is used, enables substantially constant continuous voltage to be supplied to the terminals of the capacitor 54 that is to say between the terminals 7' and 8*a*. In addition, in the case of failure, especially of the Zener diode 55, an over-voltage cannot be produced. It will be noted lastly that the capacitor 52 can not heat up (this is, by nature, a reactive element); the reliability and safety of the assembly shown in FIG. 2 are hence further improved. In fact, there is usually employed, in place of this capacitor 52, whose role is to reduce the voltage applied between the terminals of the Zener diode 55, a resistor which dissipates energy in the form of the Joule effect.

As regards the assembly shown in FIG. 2 it will lastly be mentioned that a fuse 60 connects terminal 40 to the resistor 51 of low value.

In a particular embodiment of the device shown in in FIG. 2, the following values are selected for certain of the elements of this assembly:

| | |
|---|---|
| resistor 4a | 4.7 M Ω |
| resistor 34 | 100 K Ω |
| capacitor 33 | 1 nF |
| capacitor 50 | 10 nF |
| resistor 17a | 22 M Ω |
| resistors 46 and 49 | 22 M Ω |
| resistor 48 | 2 M Ω |
| capacitor 47 | 470 pF |
| resistor 51 | 470 Ω |
| capacitor 52 | 1.5 μF |
| capacitor 54 | 100 μF |

The generating device which has been described with regard to FIGS. 1 and 2 can lend itself to numerous modifications without departing from the scope of the invention.

Among these modifications, it should be indicated that the field effect transistor could be of the P-band type; in this case the bipolar transistor is of the PNP conductivity type.

It will also be noted that the voltage doubler device which rectifies the signal delivered at the output of the oscillator 1 (or 1*a*) and applies the rectified signal to the terminals of the coil 7 a is not indispensable in certain cases. In fact, an electrovalve sensitive to alternating current could be used.

As regards the assembly comprising capacitor 33 and its charging and discharging circuits, as a modification it could be indicated that the said discharging circuit could comprise resistors 4*a* and 17*a* and in this case, the resistor 34 could then be omitted.

In another modification, which relates also to the oscillator 1*a*, the two transistors could both be of the bipolar type.

Besides the advantages which have already been indicated above for the generator device and the detection device it can also be mentioned that the latter can be incorporated in an ignition and monitoring control assembly for a burner, especially an automatic sequence control device. Finally, the assemblies shown in FIGS. 1 and 2, may be constructed in the form of integrated, hydrid or monolithic circuits.

As is self-evident from the foregoing, the invention is in no way limited to the types of application and embodiments which have been described.

I claim:

1. In a system for generating a control signal for supplying fuel to a burner comprising flame detector means for providing a voltage responsive to detection of a flame and a circuit for generating said control signal responsive to detection of a flame by said flame detector means, whereby failure of elements of said circuit inhibits production of said control signal; the improvement wherein said circuit comprises an astable multivibrator consisting of a field effect transistor with means regeneratively interconnecting the drain and gate of said field effect transistor, so that output oscillations by said multivibrator is dependent upon the potential at the gate of said field effect transistor, and resistor means connected to apply said voltage to said gate, so that said multivibrator oscillates only when said flame detecting voltage has an amplitude between determined values, and means deriving said control signal from said output oscillations.

2. The system of claim 1 comprising a source of operating potential of polarity opposite said voltage with respect to a given reference point, said multivibrator comprising first said second resistor means, means connecting said first resistor means between said drain and gate, means connecting said second resistor means between said drain and reference point, a first capacitor connected between said gate and reference point, and means connecting the source of said field effect transistor to said reference point.

3. The system of claim 2 further comprising a bi-polar transistor, means connecting the emitter of said bi-polar transistor to the source of said field effect transistor, said means connecting said source of said field effect transistors to said point comprising third resistor means, a resistive divider connected between said drain and reference point, means connecting the base of said bi-polar transistor to a point on said divider, and means deriving said output oscillations from the collector of said bi-polar transistor.

4. The system of claim 1 wherein said means deriving said control signal comprises voltage doubling means, and means coupling said voltage doubling means to receive said output oscillations.

5. The system of claim 2 further comprising voltage doubling means coupled to receive said output oscillations, said voltage doubling means comprising a first rectifier having one electrode connected to said source, an output terminal, a second rectifier connected between said output terminal and the other electrode of said first rectifier, a second capacitor coupled between the junction of said rectifiers and the output of said multivibrator, and a third capacitor connected between said output terminal and said source, whereby a continuous signal of amplitude substantially equal to the peak to peak amplitude of said output oscillations is provided at said output terminal.

6. The system of claim 3 further comprising impedance matching means connected between said collector of said bi-polar transistor and said source.

7. The system of claim 6 wherein said impedance matching means comprises a second bi-polar transistor of the same conductivity type as the first mentioned bi-polar transistor, separate resistance means coupled between said source and the base and collector of said second bi-polar transistor, means connecting the base of said second bi-polar transistor to the collector of said first mentioned bi-polar transistor, and diode means coupled between the base and emitter of said second bi-polar transistor, whereby said output oscillations are derived at the emitter of said second bi-polar transistor.

8. The system of claim 2 wherein said source is a direct current source having a minimum potential greater than the maximum potential of said voltage.

9. The system of claim 2 wherein said first resistor means comprises a pair of serially connected reistors, and further comprising a second capacitor connected between the junction of said serially connected transistors and said reference point, and a diode connected between said drain and the junction of said serially connected resistors for effecting the rapid charging and slow discharging of said second capacitor.

10. The system of claim 2 wherein said source comprises first and second terminals for receiving an alternating power voltage, said second terminal being connected to said reference point, and rectifier means between said terminals for producing said operating potential.

11. The system of claim 10 wherein said first capacitor has a capacitance whereby the oscillating frequency of said multivibrator is substantially greater than the frequency of the power voltage.

12. The system of claim 10 wherein said flame detector means comprises a series circuit of a third resistor, a second capacitor, a fourth resistor and a third capacitor connected in that order between said first terminal and said reference point, said first mentioned resistor means being connected between said gate electrode and the junction of said fourth resistor and third capacitor, a first electrode connected to the junction of said second capacitor and fourth resistor, a second electrode, and high resistor means connecting said second electrode to said reference point, whereby a flame extending between said electrodes acts as a diode to produce said voltage at said second electrode.

13. The system of claim 1 wherein said flame detector means comprises first and second input terminals adapted to be connected to an alternating power source, a first resistor, a first capacitor, a second resistor and a second capacitor connected in that order between said first and second terminals, a first electrode connected between the junction of said first capacitor and second resistor, a second electrode, high resistance means connecting said second electrode to said second terminal, said first mentioned resistor means being connected between said gate and the junction of said second resistor and second capacitor, whereby a flame extending between said first and second electrodes acts as a diode to produce said voltage at said first electrode.

14. A flame detector system comprising first and second electrodes, first and second terminals adapted to be connected to an alternating power source, a first resistor, a first capacitor, a second resistor and a second capacitor connected in that order between said first and second terminals, means connecting said first electrode to the junction of said first capacitor and second resistor, high resistance means connecting said second electrode to said second terminal, whereby a flame extending between said first and second electrodes acts as a diode to result in a direct voltage across said second capacitor responsive to said flame.

15. The system of claim 14 wherein said second resistor has a value between 0.25 and 4 times the value of said first resistor.

* * * * *

UNITED STATES PATENT OFFICE

CERTIFICATE OF CORRECTION

Patent No. 3,943,386 Dated March 9, 1976

Inventor(s) Bernard Jules Alexandre Simeau

It is certified that error appears in the above-identified patent and that said Letters Patent are hereby corrected as shown below:

Column 1, line 7: Cancel "is".

line 12: Change "accodance" to --accordance--.

line 51: Change "includidng" to --including--.

Column 3, line 27: Before "the" add --in--.

line 45: After "constantly" cancel the comma.

Column 4, line 24: Change "tothe" to --to the--.

Column 7, line 2: Change "place" to --plate--.

Column 9, line 12: Change "reistors" to --resistors--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*